US009753399B2

(12) United States Patent
Takahashi

(10) Patent No.: US 9,753,399 B2
(45) Date of Patent: Sep. 5, 2017

(54) IMAGE FORMING APPARATUS AND GENUINE PRODUCT DETERMINATION METHOD

(71) Applicant: KYOCERA Document Solutions Inc., Osaka (JP)

(72) Inventor: Tomohiro Takahashi, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 15/165,302

(22) Filed: May 26, 2016

(65) Prior Publication Data

US 2016/0349665 A1 Dec. 1, 2016

(30) Foreign Application Priority Data

May 29, 2015 (JP) ..... 2015-110724

(51) Int. Cl.
*G03G 15/00* (2006.01)
*G03G 15/08* (2006.01)

(52) U.S. Cl.
CPC ..... *G03G 15/0863* (2013.01); *G03G 15/0894* (2013.01); *G03G 15/5079* (2013.01); *G03G 2215/0132* (2013.01)

(58) Field of Classification Search
CPC ..... G03G 15/0894; G03G 15/5079
USPC ..... 399/12
See application file for complete search history.

(56) References Cited

U.S. PATENT DOCUMENTS 6,711,362 B2 3/2004 Asakura
2003/0031475 A1 2/2003 Asakura
2006/0029400 A1* 2/2006 Nasu ..... H04L 9/3247 399/12
2007/0297815 A1* 12/2007 Takada ..... G03G 15/0863 399/12

FOREIGN PATENT DOCUMENTS

JP 2003-058003 A 2/2003

* cited by examiner

*Primary Examiner* — Quana M Grainger
(74) *Attorney, Agent, or Firm* — IP Business Solutions, LLC

(57) ABSTRACT

An image forming apparatus includes a toner container information storage section, a toner container information acquisition section, a toner container information readout section, a number-of-refills comparing section, a genuine product determining section, and a toner container information update section. The toner container information acquisition section is configured to acquire an identification code and a number of refills from a toner container. The number-of-refills comparing section is configured to read out, based on the acquired identification code, the number of refills of the corresponding toner container from the toner container information storage section and determine whether or not the number of refills acquired from the toner container is smaller than the read number of refills. If the number of refills acquired from the toner container is smaller than the read number of refills, the genuine product determining section determines that the toner container is a non-genuine product.

5 Claims, 8 Drawing Sheets

Fig.3

| IDENTIFICATION CODE | NUMBER OF REFILLS | NUMBER OF COPIES PRINTED |
|---|---|---|
| A107 | 3 | 6509 |
| A271 | 0 | 6281 |
| C086 | 5 | 5722 |
| B493 | 1 | 4468 |

109

IMAGE FORMING APPARATUS AND GENUINE PRODUCT DETERMINATION METHOD

INCORPORATION BY REFERENCE

This application claims priority to Japanese Patent Application No. 2015-110724 filed on May 29, 2015, the entire contents of which are incorporated by reference herein.

BACKGROUND

The present disclosure relates to image forming apparatuses and genuine product determination methods and particularly relates to a technique for determining whether or not a toner container is a genuine product.

Image forming apparatuses (for example, copiers and printers) are generally configured so that toner containers are removably attachable to the apparatuses. If a toner container attached to such an image forming apparatus runs out of toner, it is replaced with a new toner container. Furthermore, it is being promoted that used toner containers are collected and refilled with toner by manufacturers thereof and so on for reuse.

In recent years, however, non-genuine toner containers collected and refilled with toner outside a normal channel have been often used. If a non-genuine toner container is used in an image forming apparatus, the image forming apparatus not only cannot sufficiently exhibit its performance but also may cause trouble. Therefore, it is important to determine whether or not the toner container used is a genuine product.

For this reason, a technique has been proposed for determining whether or not a toner container refilled with toner is a genuine product.

SUMMARY

A technique improved over the aforementioned technique is proposed as one aspect of the present disclosure.

An image forming apparatus according to an aspect of the present disclosure includes a control unit and a memory.

The memory implements a toner container information storage section.

The control unit implements a toner container information acquisition section, a toner container information readout section, a number-of-refills comparing section, a genuine product determining section, and a toner container information update section.

The toner container information storage section is configured so that respective identification codes associated with a plurality of toner containers and respective numbers of refills of the toner containers corresponding to the respective identification codes are able to be written thereto.

The toner container information acquisition section is configured to acquire, from the toner container attached to the image forming apparatus and including a storage section storing the identification code and the number of refills indicating how many times the toner container has been refilled with toner, the identification code and the number of refills.

The toner container information readout section is configured to read out, based on the identification code acquired by the toner container information acquisition section, the number of refills associated with the identification code from the toner container information storage section.

The number-of-refills comparing section is configured to compare the number of refills read out by the toner container information readout section with the number of refills acquired by the toner container information acquisition section.

The genuine product determining section is configured to determine, based on a result of comparison of the number-of-refills comparing section, that if the number of refills acquired by the toner container information acquisition section is smaller than the number of refills stored in the toner container information storage section, the toner container is a non-genuine product and that if the number of refills acquired by the toner container information acquisition section is equal to or greater than the number of refills stored in the toner container information storage section, the toner container is a genuine product.

The toner container information update section is configured to, when the genuine product determining section determines that the toner container is a genuine product, update the number of refills of the toner container stored in the toner container information storage section to match the number of refills acquired by the toner container information acquisition section.

A genuine product determination method according to another aspect of the present disclosure is a method for determining whether or not a toner container removably attached to an image forming apparatus is a genuine product, the toner container including a storage section in which a number of refills indicating how many times the toner container has been refilled with toner and an identification code of the toner container are stored.

The genuine product determination method includes an acquisition step, a readout step, a number-of-refills comparison step, a genuine product determination step, and an update step.

The acquisition step is the step of acquiring the identification code and the number of refills from the toner container.

The readout step is the step of reading out, based on the identification code of the toner container acquired in the acquisition step, a number of refills of the toner container corresponding to the identification code from a toner container information storage section of the image forming apparatus, the toner container information storage section being configured so that respective identification codes of a plurality of toner containers are able to be written thereto and respective numbers of refills of the plurality of toner containers are also able to be written thereto in association with the respective identification codes.

The number-of-refills comparison step is the step of comparing the number of refills read out in the readout step with the number of refills acquired in the acquisition step from the toner container attached to the image forming apparatus.

The genuine product determination step is the step of determining, based on a result of comparison in the number-of-refills comparison step, that if the number of refills acquired in the acquisition step is smaller than the number of refills stored in the toner container information storage section, the toner container is a non-genuine product and that if the number of refills acquired in the acquisition step is equal to or greater than the number of refills stored in the toner container information storage section, the toner container is a genuine product.

The update step is the step of, when the toner container is determined to be a genuine product, updating the number of refills of the toner container stored in the toner container information storage section to match the number of refills acquired from the toner container.

BRIEF DESCRIPTION OF THE DRAWINGS

FIG. 3 is a table showing an example of a data structure of a toner container information database.

DETAILED DESCRIPTION

Figure 1:
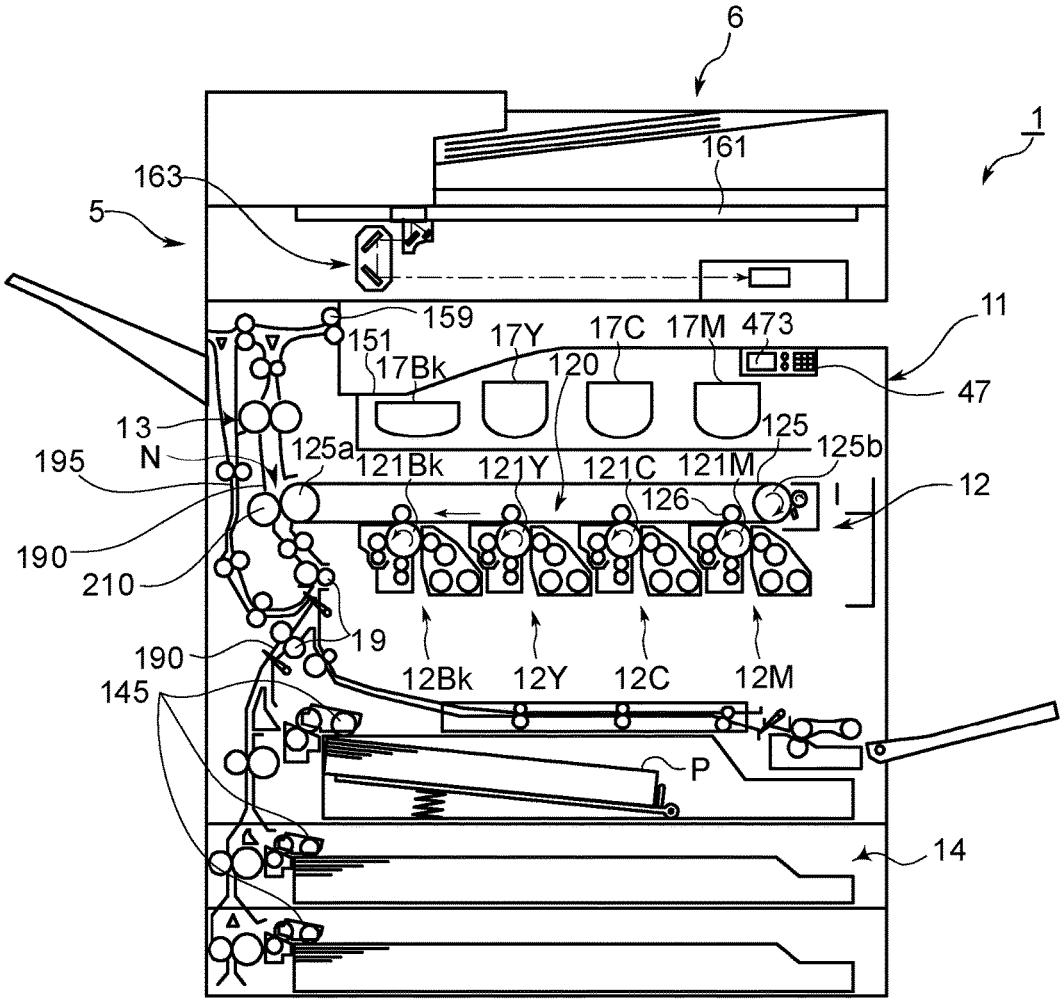
FIG. 1 is a schematic, partial cross-sectional front view showing the structure of an image forming apparatus according to an embodiment of the present disclosure.

A description will be given below of an image forming apparatus and a genuine product determination method, both according to one embodiment of the present disclosure. FIG. 1 is a schematic, partial cross-sectional front view showing the structure of an image forming apparatus according to one embodiment of the present disclosure.

The image forming apparatus 1 according to the one embodiment of the present disclosure is a multifunction peripheral having a plurality of functions including, for example, a copy function, a print function, a scan function, and a facsimile function. The image forming apparatus 1 is made up so that an apparatus body 11 thereof includes an operating section 47, a document conveyance section 6, and an image reading section 5.

The operating section 47 is configured to accept operator's instructions for various types of operations and processing executable on the image forming apparatus 1, such as an instruction to perform an image forming operation and an instruction to perform a document reading operation, and includes a display 473 configured to display operation guidance and so on for the operator.

First, a description will be given of the case where the document reading operation is performed on the image forming apparatus 1. The image reading section 5 including a reader 163 optically reads an image of an original document being fed by the document conveyance section 6 or an image of an original document placed on an original glass plate 161 and generates image data. The image data generated by the image reading section 5 is stored on an internal HDD (hard disk drive), a network-connected computer or the like.

Next, a description will be given of the case where the image forming operation is performed on the image forming apparatus 1. An image forming section 12 forms a toner image on a paper sheet P serving as a recording paper sheet fed from a sheet feed section 14, based on image data generated by the document reading operation, image data stored on the internal HDD or image data received from a network-connected computer.

The image forming section 12 is made up by including an image forming unit 12Bk for black (Bk), an image forming unit 12Y for yellow (Y), an image forming unit 12C for cyan (C), and an image forming unit 12M for magenta (M). The image forming units 12Bk, 12Y, 12C, and 12M include their respective drum-type photoconductors 121Bk, 121Y, 121C, and 121M. The photoconductors 121Bk, 121Y, 121C, and 121M are configured to be driven into rotation counterclockwise in the figure.

Toner containers 17Bk, 17Y, 17C, and 17M contain toners for black, yellow, cyan, and magenta, respectively, are located away from the respective associated photoconductors 121Bk, 121Y, 121C, and 121M and above them with an intermediate transfer belt 125 in between, and removably attached to their respective toner container attachment sections (not shown) provided in the apparatus body 11.

A transfer unit 120 is made up by including: the intermediate transfer belt 125 having an outer peripheral surface to which a toner image is to be transferred; a drive roller 125*a*; a driven roller 125*b*; and four primary transfer rollers 126.

The intermediate transfer belt 125 is mounted between the drive roller 125*a* and the driven roller 125*b* and configured to be driven in engagement against the peripheral surfaces of the photoconductors 121Bk, 121Y, 121C, and 121M by the drive roller 125*a* and travel in an endless path around the rollers 125*a*, 125*b* while synchronizing with each photoconductor 121Bk, 121Y, 121C, 121M.

Next, a description will be given of the case where color printing is performed. The peripheral surfaces of the photoconductors 121Bk, 121Y, 121C, and 121M are uniformly electrically changed (charging process), the charged surfaces of the photoconductors 121Bk, 121Y, 121C, and 121M are irradiated with laser light based on image data to form respective latent images thereon (exposure process), the latent images are made visible with toner (development process), and the toner images formed by making the visible images are transferred onto the intermediate transfer belt 125 by the primary transfer rollers 126.

The toner images of different colors (black, yellow, cyan, and magenta) transferred to the intermediate transfer belt 125 are superimposed each other on the intermediate transfer belt 125 by adjusting their transfer timings, resulting in a multicolor toner image.

A secondary transfer roller 210 is configured to transfer the multicolor toner image formed on the surface of the intermediate transfer belt 125, at a nip N between the secondary transfer roller 210 and the drive roller 125*a* with the intermediate transfer belt 125 in between, to a paper sheet P conveyed from the sheet feed section 14 along a conveyance path 190. The description given thus far is of the case of color printing. In the case of black-and-white printing, the photoconductors 121Y, 121C, and 121M for yellow, cyan, and magenta are not used and only the photoconductor 121Bk for black is used.

A fixing section 13 is configured to fix the toner image on the paper sheet P by the application of heat and pressure. The paper sheet P on which a multicolor image has been formed and fixed is discharged to a sheet output tray 151.

The sheet feed section 14 is made up by including a plurality of sheet feed cassettes and their respective pick-up rollers 145 for picking up recording paper sheets contained in the sheet feed cassettes. To pick up a recording paper sheet of a size designated by an operator's instruction or the like, the relevant pick-up roller 145 is rotationally driven. Thus, the designated recording paper sheet is fed toward the nip N.

A description will be given of the case where double-sided printing is performed on the image forming apparatus 1. The paper sheet P having an image already formed on one side by the image forming section 12 is nipped by an output roller pair 159, then moved back and conveyed to a reverse conveyance path 195 by the output roller pair 159, and conveyed again upstream in the direction of conveyance by a conveyance roller pair 19. Thus, an image can also be formed on the other side of the paper sheet P.

Figure 2:
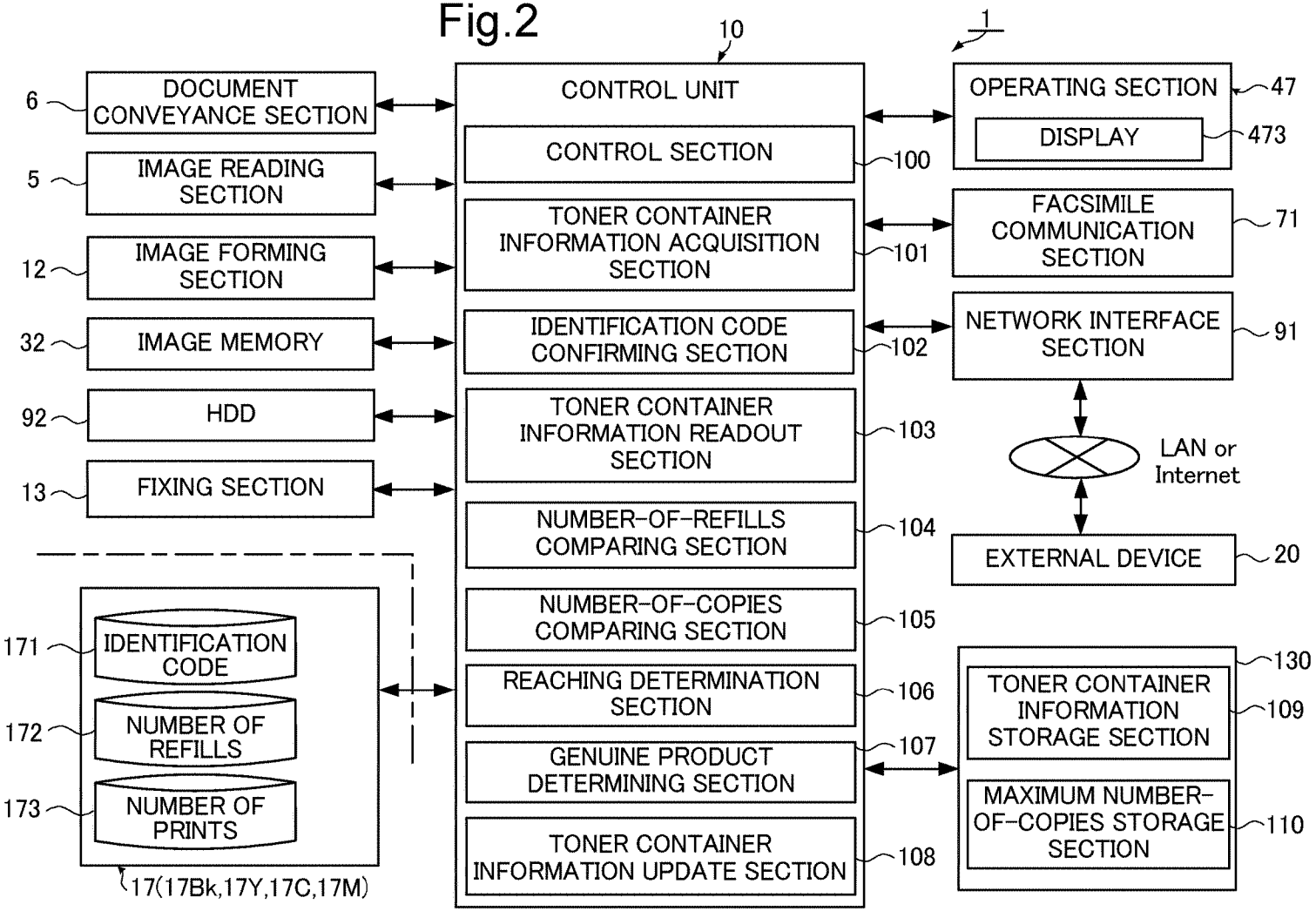
FIG. 2 is a functional block diagram schematically showing an essential internal configuration of the image forming apparatus.

FIG. 2 is a functional block diagram schematically showing an essential internal configuration of the image forming apparatus 1. The image forming apparatus 1 is made up by including a control unit 10, the document conveyance section 6, the image reading section 5, the image forming section 12, an image memory 32, an HDD 92, the fixing section 13, the operating section 47, a facsimile communication section 71, a network interface section 91, and the toner containers 17 (17Bk, 17Y, 17C, 17M). The same components as those of the image forming apparatus 1 shown in FIG. 1 will be designated by the same references and no further detailed explanation thereof will be given here.

Each toner container 17 includes: an identification code memory 171 in which an identification code assigned to the individual toner container is stored; a number-of-refills memory 172 to which the number of refills (refill times) indicating how many times the toner container has been refilled with toner can be written; and a number-of-prints memory 173 to which the number of copies printed can be written. In an initial state, "0" is written as the number of refills and the number of copies printed to the number-of-refills memory 172 and the number-of-prints memory 173, respectively.

The control unit 10 is made up by including a processor, a RAM (random access memory), a ROM (read only memory), and a dedicated hardware circuit. The processor is, for example, CPU (central processing unit), ASIC (application specific integrated circuit), or MPU (micro processing unit). The control unit 10 includes: a control section 100 governing the overall operation control of the image forming apparatus 1; a toner container information acquisition section 101; an identification code confirming section 102; a toner container information readout section 103; a number-of-refills comparing section 104; a number-of-copies comparing section 105; a reaching determination section 106; a genuine product determining section 107; and a toner container information update section 108.

Furthermore, the control unit 10 is connected to a memory 130. The memory 130 may be any storage devices, for example, an EEPROM (electrically erasable programmable read-only memory), an HDD, a semiconductor memory, or a ROM. The memory 130 includes a toner container information storage section 109 and a maximum number-of-copies storage section 110 in which the maximum number of copies printable per toner container (for example, 10,000 copies).

The toner container information storage section 109 contains respective identification codes associated with the toner containers and contains respective numbers of refills R1 and respective numbers of copies printed P1 of the toner containers on an identification code-by-identification code basis. FIG. 3 is a table showing an example of a data structure of a toner container information storage section 109. The toner container information storage section 109 is capable of storing a plurality of identification codes and storing respective numbers of refills and respective numbers of copies printed of the toner containers in association with the respective identification codes. For example, the toner container information storage section 109 contains, in association with the identification code "A107", the number of refills "3" and the number of copies printed "6509" of the toner container 17 to which the identification code "A107" is assigned. Each identification code also serves as ID data unique for the associated toner container.

Also, the control unit 10 shown in FIG. 2 functions as the control section 100, the toner container information acquisition section 101, the identification code confirming section 102, the toner container information readout section 103, the number-of-refills comparing section 104, the number-of-copies comparing section 105, the reaching determination section 106, the genuine product determining section 107, and the toner container information update section 108 by operating in accordance with a control program installed on the HDD 92. The memory connected to the control unit 10 functions as a toner container information storage section 109 and a maximum number-of-copies storage section 110 in which the maximum number of copies printable per toner container (for example, 10,000 copies) is stored. However, each of the above-mentioned control section 100 and other sections may not be implemented by the operation of the control unit 10 in accordance with the control program but may be constituted by a hardware circuit. Hereinafter, the same applies to the other embodiments unless otherwise stated.

The control section 100 is connected to the document conveyance section 6, the image reading section 5, the image forming section 12, the image memory 32, the HDD 92, the fixing section 13, the operating section 47, the facsimile communication section 71, the network interface section 91, and the toner containers 17 and controls the operations of these components.

The toner container information acquisition section 101 is configured to acquire from each toner container 17 its identification code, number of refills R1, and number of copies printed P1. For example, each toner container 17 is provided with an RFID tag having a memory. Furthermore, the image forming apparatus 1 is provided with an RFID reader capable of communicating with the RFID tag. The toner container information acquisition section 101 acquires, from the toner container 17 through communication of the RFID reader with the RFID tag, the identification code, the number of refills R1, and the number of copies printed P1 all of which are stored in the memory of the RFID tag.

The identification code confirming section 102 is configured to confirm whether or not the identification code of the toner container 17 acquired by the toner container information acquisition section 101 has been stored in the toner container information storage section 109. For example, the identification code confirming section 102 is configured to search for an identification code stored in the toner container information storage section 109 and, if finding the identification code matching the acquired identification code, determine that the acquired identification code has been stored in the toner container information storage section 109.

The toner container information readout section 103 is configured to read out the number of refills R2 and number of copies printed P2 of the relevant toner container 17 from the toner container information storage section 109 in which the number of refills R2 and number of copies printed P2 are stored in association with the identification code of the toner container 17 acquired by the toner container information acquisition section 101.

The number-of-refills comparing section 104 is configured to compare the number of refills R2 read out by the toner container information readout section 103 with the number of refills R1 of the toner container 17 acquired by the toner container information acquisition section 101. For example, the number-of-refills comparing section 104 determines whether the number of refills R1 is smaller than, equal to or greater than the number of refills R2.

The number-of-copies comparing section 105 is configured to compare the number of copies printed P2 read out by the toner container information readout section 103 with the number of copies printed P1 of the toner container 17 acquired by the toner container information acquisition section 101. For example, the number-of-copies comparing section 105 determines whether the number of copies printed P1 is smaller than, equal to or greater than the number of copies printed P2.

The reaching determination section 106 is configured to determine whether or not the number of copies printed P1 of the toner container 17 acquired by the toner container information acquisition section 101 has reached the maximum number of copies printed P3 stored in the maximum number-of-copies storage section 110. For example, the reaching determination section 106 determines whether or not the number of copies printed P1 is equal to the maximum number of copies printed P3 and, if equal, determines that the number of copies printed P1 has reached the maximum number of copies printed P3.

The genuine product determining section 107 is configured to determine whether or not the toner container 17 is a genuine product based on the result of comparison of the number-of-refills comparing section 104. For example, if the result of comparison of the number-of-refills comparing section 104 indicates that the number of refills R1 is smaller than the number of refills R2, the genuine product determining section 107 determines that the toner container 17 is a non-genuine product. If the result of comparison indicates that the number of refills R1 is equal to or greater than the number of refills R2, the genuine product determining section 107 determines, on condition that an additional requirement is satisfied, that the toner container 17 is a genuine product. In this embodiment, a description will be given hereinafter of an example where the genuine product determining section 107 determines whether or not the toner container 17 is a genuine product based not only on the result of comparison of the number-of-refills comparing section 104 but also on, as additional requirements, the result of comparison of the number-of-copies comparing section 105 and the result of determination of the reaching determination section 106.

If the genuine product determining section 107 determines that the toner container 17 is a genuine product, the toner container information update section 108 updates the number of refills R2 and number of copies printed P2 of the toner container 17 stored in the toner container information storage section 109 to match the number of refills R1 and number of copies printed P1, respectively, acquired by the toner container information acquisition section 101.

The following is a description of the case where the toner container 17 has been collected and refilled with toner by the manufacturer thereof or the manufacturer of the image forming apparatus 1.

Figure 4:
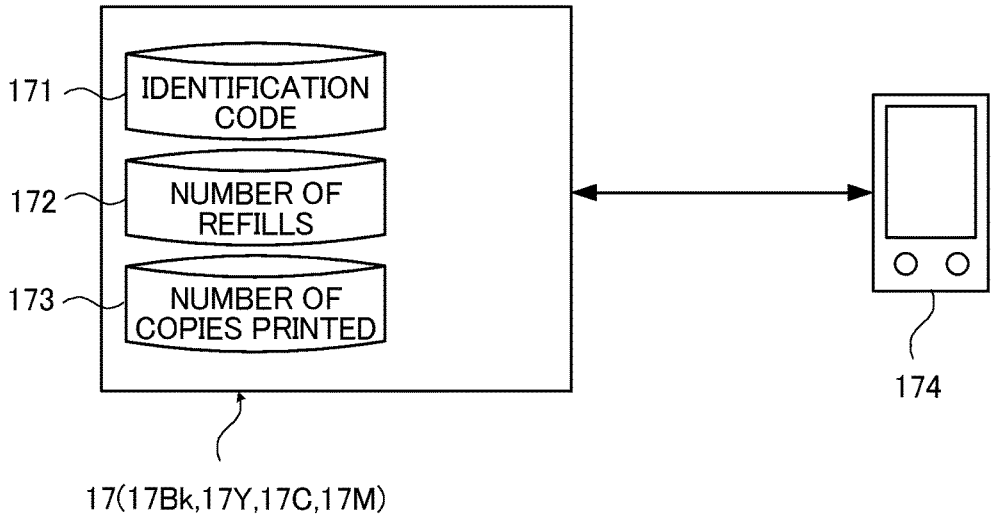
FIG. 4 is a view schematically showing a toner container and a terminal device which a person for doing toner refilling uses.

FIG. 4 is a view schematically showing a toner container and a terminal device which a person for doing toner refilling uses. The terminal device 174 is intended for use by persons for doing toner refilling of the toner containers 17. The terminal device 174 includes a CPU, a RAM, and a ROM. The terminal device 174 has the function of reading out data stored in the toner containers 17 and writing data to the toner containers 17.

Figure 5:
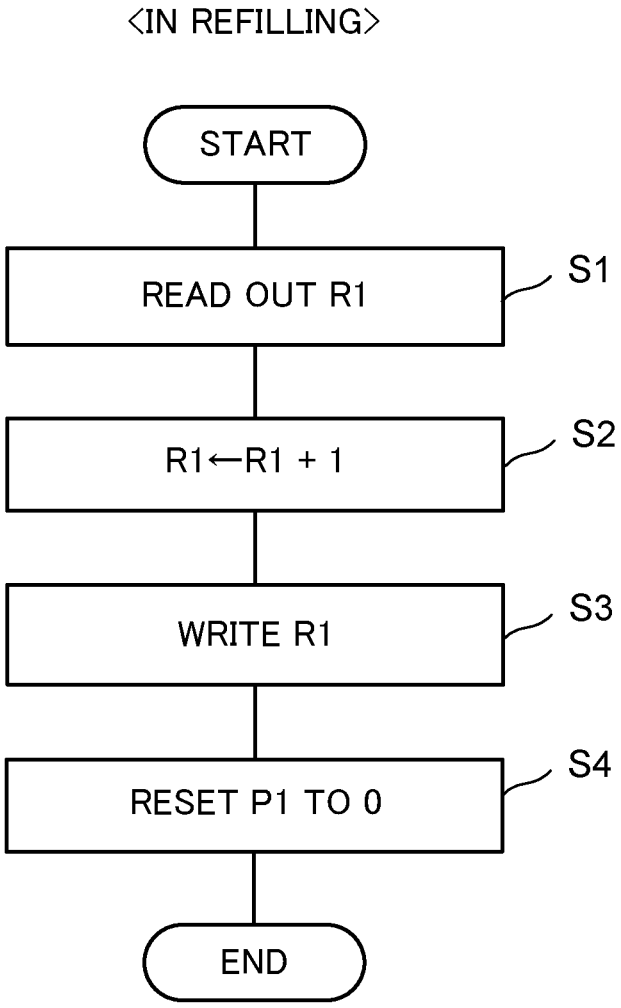
FIG. 5 is a flowchart showing data transfer between the terminal device and the toner container.

FIG. 5 is a flowchart showing data transfer between the terminal device 174 and each of the toner containers 17.

When the manufacturer of the toner container 17 or the manufacturer of the image forming apparatus 1 completes toner refilling of a toner-free used toner container 17 collected from a user, he/she uses the terminal device 174 to perform the following processing for the toner container refilled with toner.

The control section of the terminal device 174 communicates with the number-of-refills memory 172 (an example of the storage section defined in "What is claimed is") of the toner container 17. The number-of-refills memory 172 and the number-of-prints memory 173 are each formed of, for example, the above-mentioned memory provided in the RFID tag. The terminal device 174 is provided with an RFID reader capable of communicating with the RFID tag. The terminal device 174 reads out the number of refills R1 from the number-of-refills memory 172 (S1), counts up the read number of refills R1 by "1" (S2), writes the counted number of refills R1 to the number-of-refills memory 172 of the toner container 17 (S3), and resets the number of copies printed P1 stored in the number-of-prints memory 173 of the toner container 17 to "0" (S4).

Figure 6:
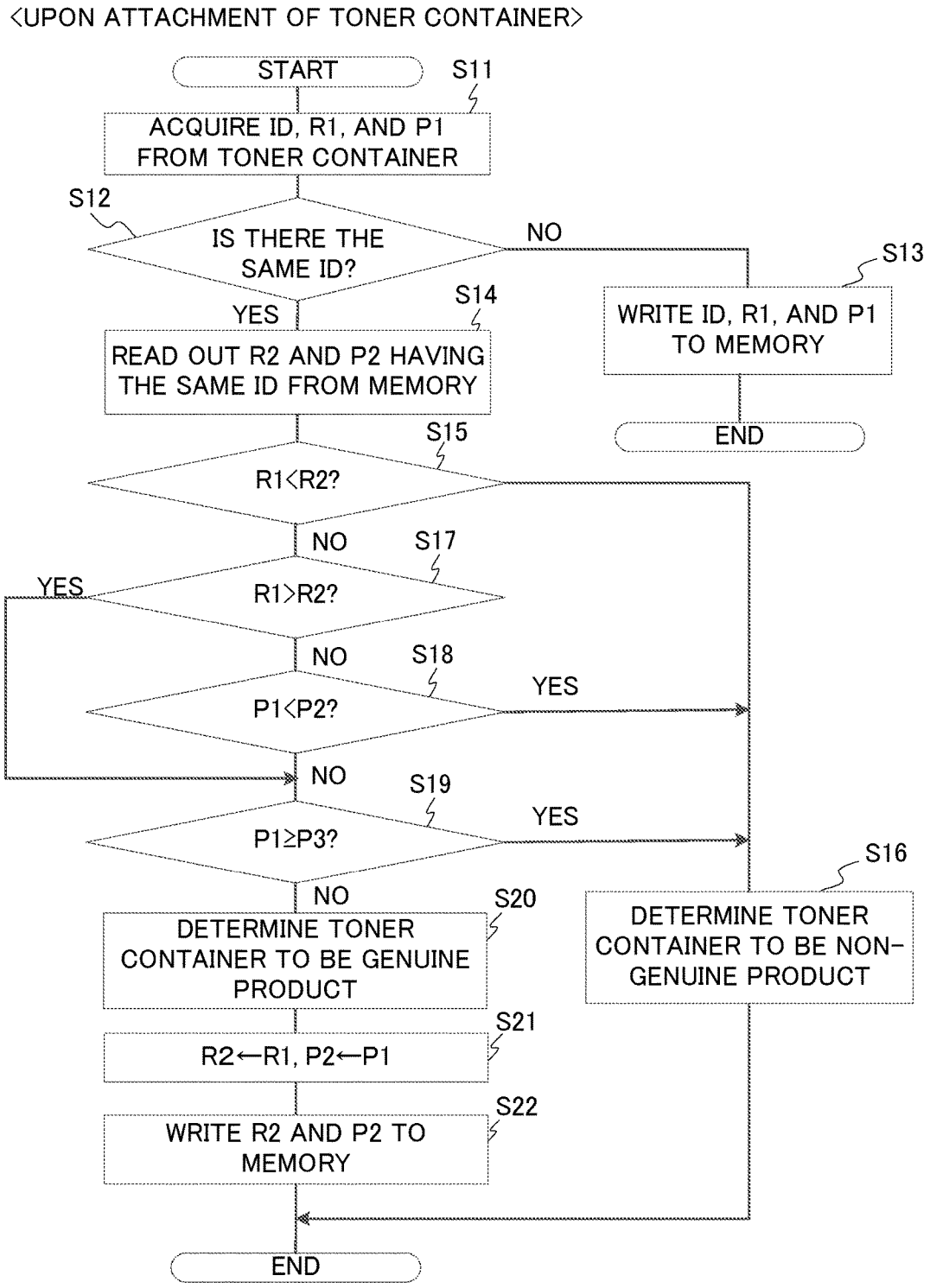
FIG. 6 is a flowchart showing genuine product determination processing performed by a control unit of the image forming apparatus.
Figure 7:
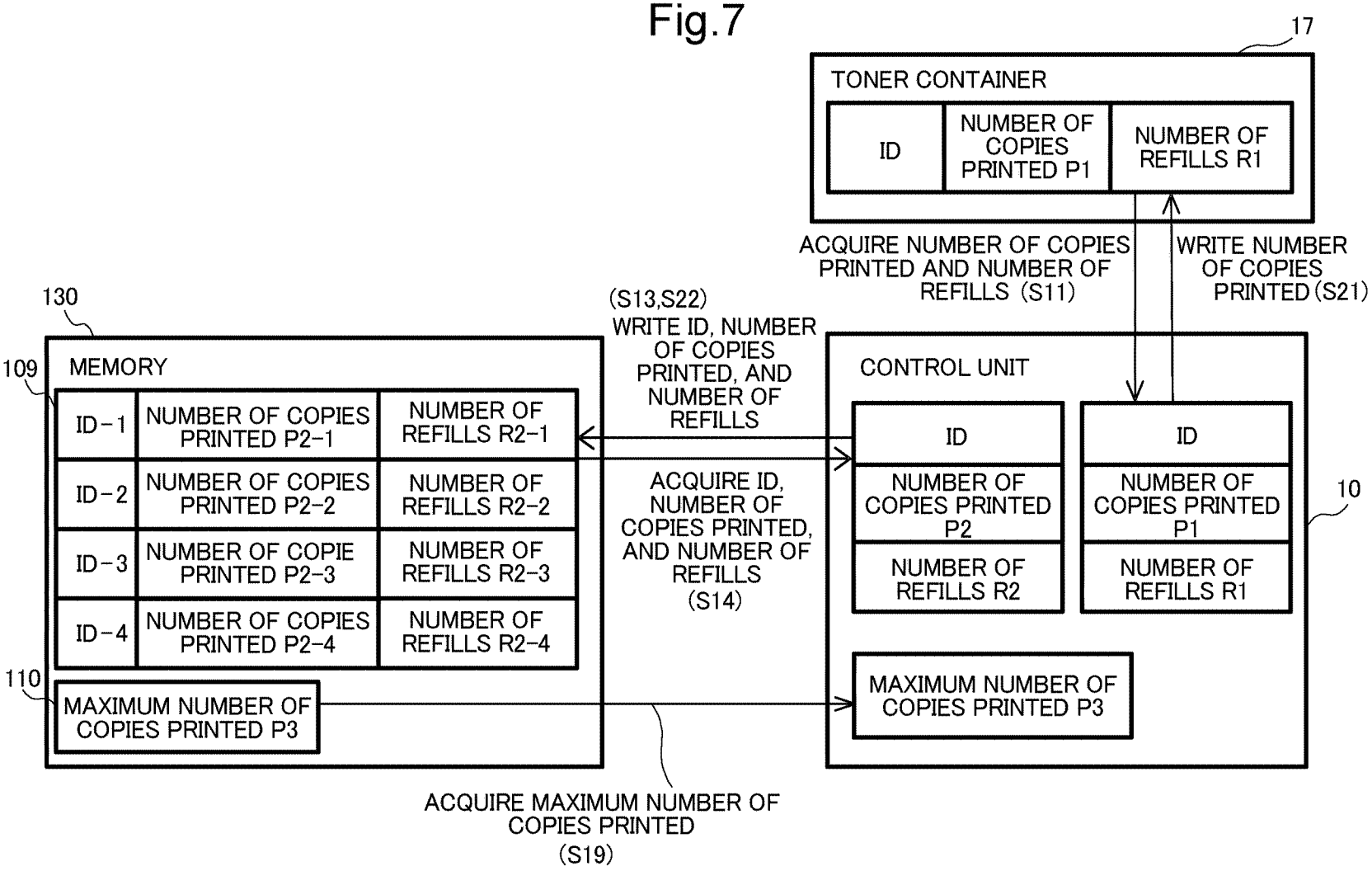
FIG. 7 is a block diagram showing how each piece of information is read out and written in the genuine product determination processing.

Next, a description will be given of a method for determining whether the toner container 17 is a genuine product upon attachment to the apparatus body. FIG. 6 is a flowchart showing genuine product determination processing performed by the control unit 10 of the image forming apparatus 1. FIG. 7 is a block diagram showing how each piece of information is read out and written in the genuine product determination processing.

When the toner container 17 is attached to the apparatus body 11 of the image forming apparatus 1 and thus the RFID reader of the image forming apparatus 1 and the RFID tag of the toner container 17 come within range for mutual communication, the toner container information acquisition section 101 acquires the identification code ID, the number of refills R1, and the number of copies printed P1 from the toner container 17 attached to the apparatus body 11 (S11). Then, the identification code confirming section 102 determines whether or not the same identification code as the acquired identification code ID is stored in the toner container information storage section 109 (S12).

If the identification code confirming section 102 determines that the same identification code as the acquired identification code ID is not stored in the toner container information storage section 109 (NO in S12), the toner container information update section 108 writes the acquired identification code ID to the toner container information storage section 109 and further writes the acquired number of refills R1 and number of copies printed P1 in association with the identification code ID to the toner container information storage section 109 (S13).

In other words, when a new toner container 17 having never been attached to the apparatus body 11 is attached to the apparatus body 11, the toner container information update section 108 writes the identification code ID, the number of refills R1, and the number of copies printed P1 of the new toner container 17 as initial values to the toner container information storage section 109.

Thus, if the number of refills R1 of the toner container 17 attached to the apparatus body 11 is smaller than the number of refills R2 stored in the toner container information storage section 109, the relationship between the number of refills R1 and the number of refills R2, which indicates that the attached toner container 17 is a non-genuine product, is held.

On the other hand, if the identification code confirming section 102 determines that the same identification code as the acquired identification code ID is stored in the toner container information storage section 109 (YES in S12), the toner container information readout section 103 reads out, based on the acquired identification code ID, the number of refills R2 and number of copies printed P2 of the corresponding toner container 17 from the toner container information storage section 109 (S14). The toner container information storage section 109 contains, as shown in FIG. 7, the numbers of refills R2 and the numbers of copies printed P2 on an identification code-by-identification code basis.

Next, the number-of-refills comparing section 104 determines whether or not the number of refills R1 acquired from the toner container 17 is smaller than the number of refills R2 read out from the toner container information storage section 109 (S15). If the number-of-refills comparing section 104 determines that the number of refills R1 is smaller than the number of refills R2 (i.e., the number of refills has not been counted up in the correct way) (YES in S15), the genuine product determining section 107 determines that the toner container 17 is a non-genuine product (i.e., it is not one collected and refilled with toner through a normal channel (S16).

If the toner container 17 has been refilled with toner in the way described previously with reference to FIG. 5, then either one of the following two cases should hold true: (1) since the number of refills R1 has been updated by incrimination, the number of refills R2 of the toner container 17 being stored in the toner container information storage section 109 and not yet reflecting the incrimination is smaller than the number of refills R1; and (2) if the toner container 17 has been removed from the apparatus body 11 and then attached thereto again without being refilled with toner, the number of refills R1 has not been incremented, so that the number of refills R2 of the toner container 17 being stored in the toner container information storage section 109 is equal to the number of refills R1.

If the number of refills R1 is smaller than the number of refills R2, this is attributed to incompletion of the above-described refilling step and processing step using the terminal device 174 (FIG. 5) to be performed by the manufacturer of the toner container 17 or the image forming apparatus 1 (hereinafter referred to as the normal steps) and, specifically, it can be assumed that the toner container 17 has been collected and refilled with toner differently from the normal steps and the number of refills R1 has been reset to "0" or counted down for any reason without the above normal processing. Therefore, if the number of refills R1 of the toner container 17 is smaller than the number of refills R2, it can be determined that the toner container 17 is a non-genuine product.

On the other hand, if in S15 the number-of-refills comparing section 104 determines that the number of refills R1 is not smaller than the number of refills R2 (NO in S15), the number-of-refills comparing section 104 subsequently determines whether or not the number of refills R1 acquired from the toner container 17 is greater than the number of refills R2 read out from the toner container information storage section 109 (S17).

If the number-of-refills comparing section 104 determines that the number of refills R1 is not greater than the number of refills R2 (i.e., the number of refills R1 is equal to the number of refills R2) (NO in S17), the number-of-copies comparing section 105 determines whether or not the number of copies printed P1 acquired from the toner container 17 is smaller than the number of copies printed P2 read out from the toner container information storage section 109 (S18).

The following three cases can be considered as the cases where the number-of-refills comparing section 104 determines that the number of refills R1 is equal to the number of refills R2 (NO in S17).

Case 1: A toner container 17 removed from the apparatus has been attached to the same apparatus again as it is (use in a normal way).

Case 2: A toner container 17 removed from the apparatus has been temporarily attached to another apparatus and then attached to the original apparatus again (use in a normal way).

Case 3: A toner container 17 refilled with toner outside the normal channel, of which the number of refills was not counted up, has been attached to the apparatus (use out of the normal way).

If in S18 the number-of-copies comparing section 105 determines that the number of copies printed P1 is smaller than the number of copies printed P2 (YES in S18), the genuine product determining section 107 determines that the toner container 17 is a non-genuine product (S16).

In Case 1, the number of copies printed P1 is equal to the number of copies printed P2. In Case 2, the number of copies printed P1 is equal to or greater than the number of copies printed P2. Therefore, the case where the number of copies printed P1 is smaller than the number of copies printed P2 applies, not to Cases 1 and 2, but to Case 3 (use out of the normal way).

On the other hand, if in S17 it is determined that the number of refills R1 is greater than the number of refills R2 (YES in S17) or in S18 it is determined that the number of copies printed P1 is not smaller than the number of copies printed P2 (NO in S18), the number-of-copies comparing section 105 acquires the maximum number of copies printed P3 from the maximum number-of-copies storage section 110 and determines whether or not the number of copies printed P1 is equal to or greater than the maximum number of copies printed P3 (S19).

If the number-of-copies comparing section 105 determines that the number of copies printed P1 is equal to or greater than the maximum number of copies printed P3 (YES in S19), the genuine product determining section 107 determines that the toner container 17 is a non-genuine product (S16).

When the toner container 17 is collected and refilled with toner through the normal channel, the number of copies printed P1 is reset to "0" (see S4 in FIG. 5). Therefore, so long as the toner container 17 is a genuine product, there is no way that the number of copies printed P1 reaches the maximum number of copies printed P3.

On the other hand, if in S19 the number-of-copies comparing section 105 determines that the number of copies printed P1 is neither equal to nor greater than the maximum number of copies printed P3 (NO in S19), the genuine product determining section 107 determines that the toner container 17 is not a non-genuine product (i.e., is a genuine product) (S20). If it is thus determined that the toner container 17 is a genuine product, the toner container information update section 108 modifies the number of refills R2 and the number of copies printed P2 to the number of refills R1 and the number of copies printed P1, respectively, (S21) and updates, based on the identification code ID, the associated number of refills and number of copies printed of the toner container 17 stored in the toner container information storage section 109 to the modified number of refills R2 and number of copies printed P2, respectively, (S22). In other words, when a genuine toner container 17 is attached to the apparatus body 11, the number of refills R2 and number of copies printed P2 stored in association with the toner container 17 in the toner container information storage section 109 are rewritten as the number of refills R1 and the number of copies printed P1, respectively. Thus, information on the number of copies printed necessary for determining whether or not the toner container 17 is a non-genuine product based on the number of copies printed P1 of the toner container 17 attached to the apparatus body 11 is stored in the toner container 17 and the toner container information storage section 109.

Figure 8:
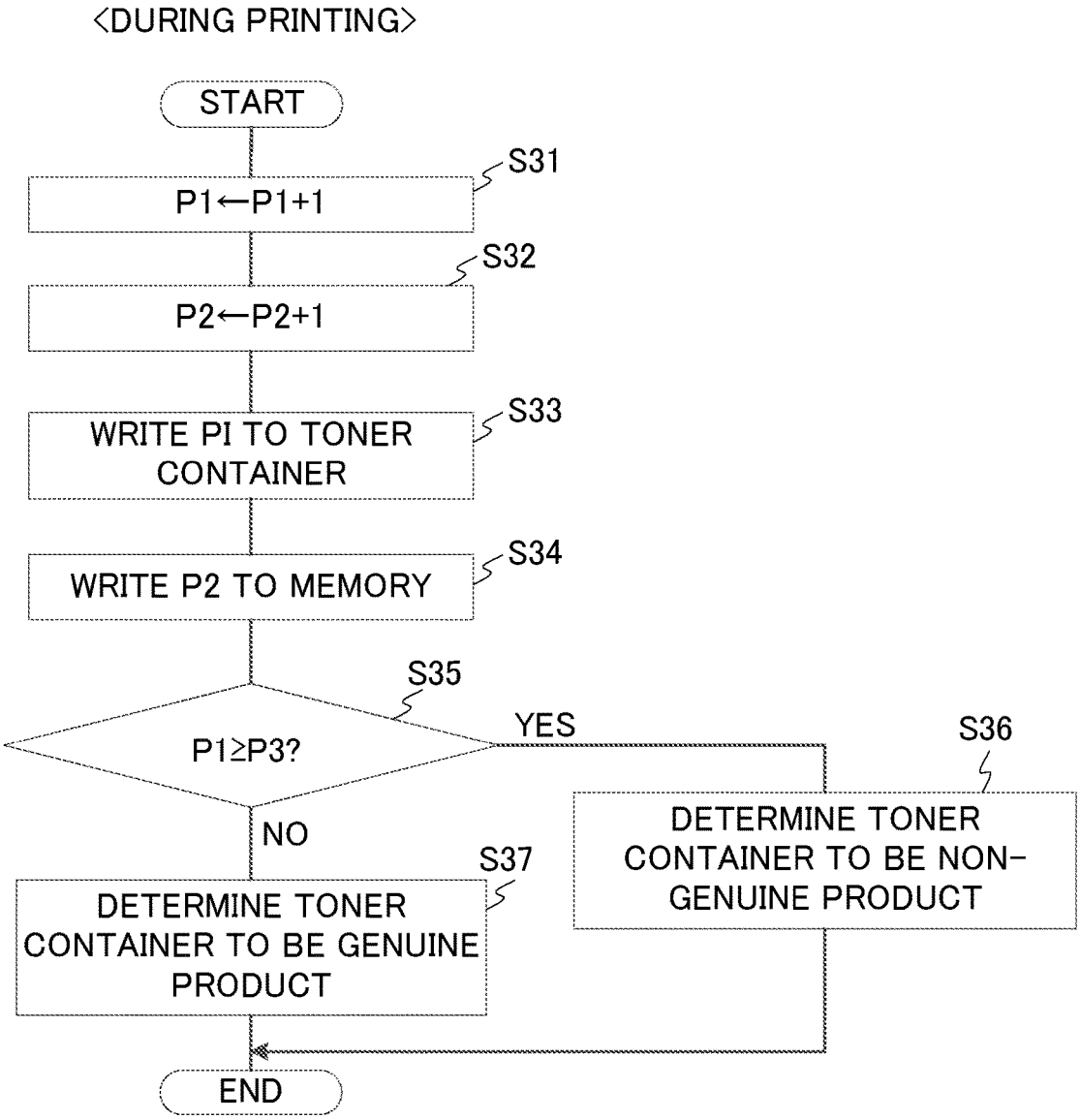
FIG. 8 is a flowchart showing another genuine product determination processing performed by the control unit of the image forming apparatus.

Next, a description will be given of a method for determining, during printing, whether the toner container 17 is a genuine product. FIG. 8 is a flowchart showing another genuine product determination processing performed by the control unit 10 of the image forming apparatus 1.

Every time a copy is printed, the toner container information update section 108 counts up the numbers of copies printed P1 and P2 by "1" (S31, S32) and writes the number of copies printed P1 to the number-of-prints memory 173 of the toner container 17 attached to the apparatus body 11 (S33). Also, the toner container information update section 108 updates, based on the identification code ID, the associated number of copies printed of the toner container 17 stored in the toner container information storage section 109 to the number of copies printed P2 (S34).

Next, the number-of-copies comparing section 105 determines whether or not the number of copies printed P1 is equal to or greater than the maximum number of copies printed P3 (S35). If the number-of-copies comparing section 105 determines that the number of copies printed P1 is equal to or greater than the maximum number of copies printed P3 (YES in S35), the genuine product determining section 107 determines that the toner container 17 is a non-genuine product (S36).

On the other hand, if the number-of-copies comparing section 105 determines that the number of copies printed P1 is neither equal to nor greater than the maximum number of copies printed P3 (NO in S35), the genuine product determining section 107 determines that the toner container 17 is not a non-genuine product (i.e., is a genuine product) (S37).

In this embodiment, the toner container which is not used in the above-described normal way (is not a genuine product) is determined to be a non-genuine product. Therefore, a non-genuine toner container can be accurately detected.

Furthermore, since respective identification codes of a plurality of toner containers 17 and respective numbers of refills of the toner containers 17 associated with the respective identification codes can be written to the toner container information storage section 109, this enables each toner container 17 to be shared among a plurality of image forming apparatuses 1.

Thus, it can be prevented that a non-genuine toner container attached to the apparatus body 11 is treated as a genuine product and the user can be notified that the non-genuine product is used, resulting in prompting the user to use a genuine product.

In other words, in the above embodiment, the previous number of refills does never become smaller than the subsequent number of refills so long as the toner container is used in the normal way to correctly count up the number of refills (i.e., unless the number of refills is incorrectly reset or counted down). In still other words, if the previous number of refills is smaller than the subsequent number of refills, it cannot be said that the toner container is used in the normal way.

Therefore, in accordance with the above embodiment, the toner container that cannot be said to be used in the normal way (cannot be accepted as a genuine product) is determined to be a non-genuine product, which prevents such a non-genuine product from being incorrectly determined to be a genuine product.

In an example of a general technique for determining whether or not a toner container is a genuine product, the count value updated at every replacement of toner container (toner cartridge) is used to determine whether or not the count value stored on the toner container side matches the count value stored on the apparatus body side and, if both the count values match each other, the toner container is determined to be a genuine product.

However, this technique does not take into consideration the sharing of the toner container among a plurality of image forming apparatuses and makes an erroneous determination if the toner container is shared among the plurality of image forming apparatuses.

For example, many business establishments and the like where some kind of image forming apparatus is installed use a plurality of image forming apparatuses. If in such a business establishment a toner container refilled with toner is attached to an image forming apparatus different from that to which it was attached before refilling, the toner container, even if a genuine product, will be erroneously determined to be a non-genuine product because the count value stored on the toner container side does not match the count value stored on the apparatus body side.

Unlike this, in the above embodiment, it can be accurately determined whether or not the toner container refilled with toner is a genuine product.

The present disclosure is not limited to the above embodiment and can be modified in various ways. Although the description of the above embodiment is given taking a multifunction peripheral as an example of the image forming apparatus according to the present disclosure, the example is merely illustrative and the image forming apparatus may be any other image forming apparatus, including other electronic devices, such as a printer, a copier, and a facsimile machine.

The structure, configuration, and processing shown in the above embodiment with reference to FIGS. 1 to 8 are merely illustrative of the present disclosure and the present disclosure is not intended to be limited to the above structure, configuration, and processing.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. An image forming apparatus comprising a control unit and a memory, wherein the memory includes a toner container information storage section to which respective identification codes associated with a plurality of toner containers and respective numbers of refills of the toner containers corresponding to the respective identification codes are able to be written, and the control unit includes:

a toner container information acquisition section configured to acquire, from the toner container attached to the image forming apparatus and including a storage section storing the identification code and the number of refills indicating how many times the toner container has been refilled with toner, the identification code and the number of refills;

a toner container information readout section configured to read out, based on the identification code acquired by the toner container information acquisition section, the number of refills associated with the identification code from the toner container information storage section;

a number-of-refills comparing section configured to compare the number of refills read out by the toner container information readout section with the number of refills acquired by the toner container information acquisition section;

a genuine product determining section configured to determine, based on a result of comparison of the number-of-refills comparing section, that if the number of refills acquired by the toner container information acquisition section is smaller than the number of refills stored in the toner container information storage section, the toner container is a non-genuine product and that if the number of refills acquired by the toner container information acquisition section is equal to or greater than the number of refills stored in the toner container information storage section, the toner container is a genuine product; and a toner container information update section configured to, when the genuine product determining section determines that the toner container is a genuine product, update the number of refills of the toner container stored in the toner container information storage section to match the number of refills acquired by the toner container information acquisition section.

2. The image forming apparatus according to claim 1, wherein the toner container information storage section is configured so that in association with each of the identification codes, the number of refills and the number of copies printed of the corresponding toner container are able to be written to the toner container information storage section, the toner container information acquisition section is further configured to acquire, from the toner container attached to the image forming apparatus, the number of copies printed in addition to the identification code and the number of refills, the toner container information readout section is further configured to read out, based on the identification code acquired by the toner container information acquisition section, the number of refills and the number of copies printed associated with the identification code from the toner container information storage section, the image forming apparatus further comprises a number-of-copies comparing section configured to compare the number of copies printed read out by the toner container information readout section with the number of copies printed acquired by the toner container information acquisition section, the genuine product determining section is further configured to determine, based on the result of comparison of the number-of-refills comparing section and a result of comparison of the number-of-copies comparing section, whether or not the toner container attached to the image forming apparatus is a genuine product, the genuine product determining section determines that if the number of refills of the toner container is equal to the number of refills stored in the toner container information storage section and the number of copies printed of the toner container is smaller than the number of copies printed stored in the toner container information storage section, the toner container is a non-genuine product, and the toner container information update section is further configured to, when the genuine product determining section determines that the toner container is a genuine product, update the number of copies printed of the toner container stored in the toner container information storage section to match the number of copies printed acquired by the toner container information acquisition section.

3. The image forming apparatus according to claim 2, further comprising a reaching determination section configured to determine whether or not the number of copies printed of the toner container attached to the image forming apparatus has reached a predetermined maximum number of copies printed, wherein when the reaching determination section determines that the number of copies printed of the toner container has reached the maximum number of copies printed, the genuine product determining section determines that the toner container is a non-genuine product.

4. The image forming apparatus according to claim 1, wherein when the identification code confirming section determines that the same identification code as the identification code acquired by the toner container information acquisition section is not stored in the toner container information storage section, the toner container information update section writes the acquired identification code to the toner container information storage section and writes, in association with the identification code, the number of refills and the number of copies printed acquired by the toner container information acquisition section to the toner container information storage section.

5. A genuine product determination method for determining whether or not a toner container removably attached to an image forming apparatus is a genuine product, the toner container including a storage section in which a number of refills indicating how many times the toner container has been refilled with toner and an identification code of the toner container are stored, the method comprising:

an acquisition step of acquiring the identification code and the number of refills from the toner container;

a readout step of reading out, based on the identification code of the toner container acquired in the acquisition step, a number of refills of the toner container corresponding to the identification code from a toner container information storage section of the image forming apparatus, the toner container information storage section being configured so that respective identification codes of a plurality of toner containers are able to be written thereto and respective numbers of refills of the plurality of toner containers are also able to be written thereto in association with the respective identification codes;

a number-of-refills comparison step of comparing the number of refills read out in the readout step with the number of refills acquired in the acquisition step from the toner container attached to the image forming apparatus;

a genuine product determination step of determining, based on a result of comparison in the number-of-refills comparison step, that if the number of refills acquired in the acquisition step is smaller than the number of refills stored in the toner container information storage section, the toner container is a non-genuine product and that if the number of refills acquired in the acquisition step is equal to or greater than the number of refills stored in the toner container information storage section, the toner container is a genuine product; and an update step of, when the toner container is determined to be a genuine product, updating the number of refills of the toner container stored in the toner container information storage section to match the number of refills acquired from the toner container.

* * * * *